US008714710B2

(12) United States Patent
Rivas et al.

(10) Patent No.: US 8,714,710 B2
(45) Date of Patent: May 6, 2014

(54) PRINT HEAD

(75) Inventors: Rio Rivas, Corvallis, OR (US); Siddhartha Bhowmik, Salem, OR (US); Ed Friesen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/640,241

(22) PCT Filed: Apr. 9, 2010

(86) PCT No.: PCT/US2010/030593

§ 371 (c)(1), (2), (4) Date: Oct. 9, 2012

(87) PCT Pub. No.: WO2011/126492

PCT Pub. Date: Oct. 13, 2011

(65) Prior Publication Data

US 2013/0033548 A1 Feb. 7, 2013

(51) Int. Cl.
*B41J 2/05* (2006.01)

(52) U.S. Cl.
USPC ..... 347/61

(58) Field of Classification Search
USPC ..... 347/20, 42, 44, 47, 54, 56, 61–65, 85
See application file for complete search history.

(56) References Cited

U.S. PATENT DOCUMENTS

| | | | |
|---|---|---|---|
| 5,608,436 | A | 3/1997 | Baughman et al. |
| 6,364,467 | B1 | 4/2002 | Blair et al. |
| 6,561,632 | B2 | 5/2003 | Feinn et al. |
| 2006/0232636 | A1 | 10/2006 | Bengali |

OTHER PUBLICATIONS

International Search Report, PCT/US2010/030593, filed Apr. 9, 2010, dated Feb. 22, 2011, English.

*Primary Examiner* — Kristal Feggins

(57) ABSTRACT

Thermal inkjet print head, comprising a fluid feed channel for delivering fluid, fluid chambers arranged near the fluid feed channel for receiving fluid from the fluid feed channel, resistors for actuating the fluid in the chambers, arranged in a staggered pattern with respect to a fluid feed channel wall, and a cantilever extending over the fluid feed channel wall, having a staggered edge that follows the staggered pattern of the resistors.

16 Claims, 8 Drawing Sheets

PRINT HEAD

BACKGROUND OF THE INVENTION

This invention relates to printers, print heads, and manufacturing processes thereof. One technology of printing involves inkjet printing. Inkjet printing employs a print head that ejects fluid drops through a plurality of nozzles onto a print medium. One type of inkjet printing involves thermal inkjet (TIJ) printing. A TIJ print head oftentimes consists of a substrate having at least one ink feed channel, and a plurality of chambers receiving ink from the ink feed channel. A resistor is located in each chamber. By passing current through the associated resistor, the ink in the firing chamber is heated, causing the fluid to eject through the chamber's nozzle. It is common to stagger the resistors with respect to one another, for example corresponding to the timing of the electrical pulses to the resistors that share the same electrical circuit.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description through modification, combination or variation of certain elements. Furthermore, it may be understood that also embodiments or elements that may not be specifically disclosed in this disclosure may be derived from the description and drawings.

Figure 1:
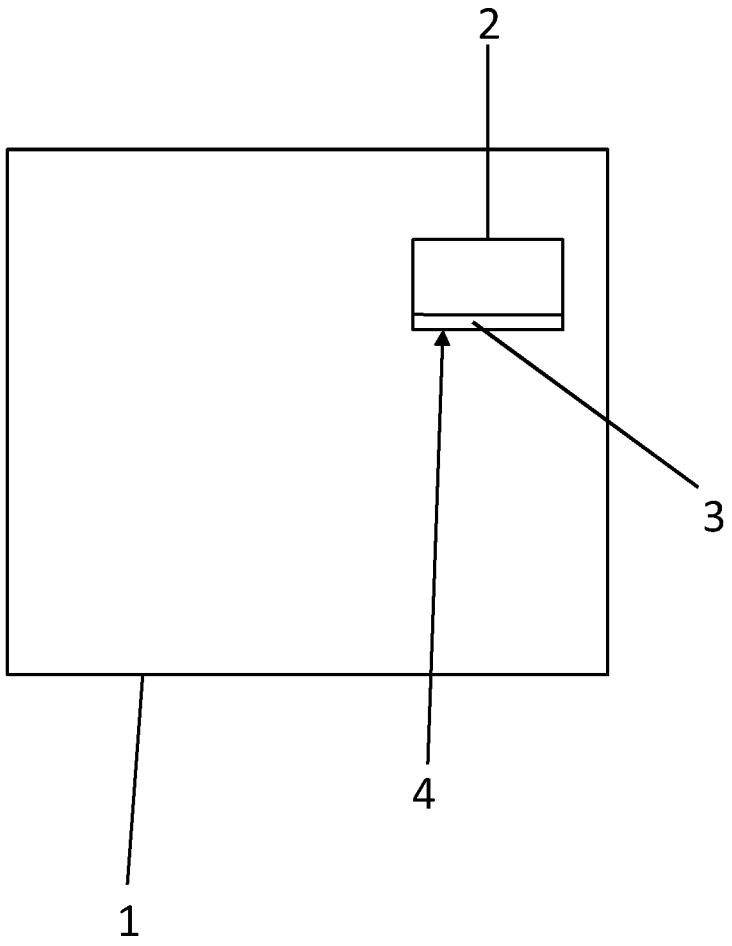
FIG. 1 shows a diagram of an embodiment of a printer with a print head.

FIG. 1 shows a diagram of a printer 1. The printer 1 may comprise an inkjet printer. The printer 1 may be arranged to be connected to a computer and/or network, or may be embedded in a further system, such as a copy and/or scanning device and/or 3D printing device. In the shown embodiment, the printer 1 comprises a scanning print head 2. In another embodiment, the print head 2 may for example comprise a page wide array print head. The print head 2 may be provided with a nozzle plate 3 having a front surface 4 with nozzles 5 (FIG. 3A) for shooting fluid out of the print head 2. The print head 2 may comprise an inkjet print head 2. The print head 2 may comprise a thermal inkjet (TIJ) print head 2.

Figure 2:
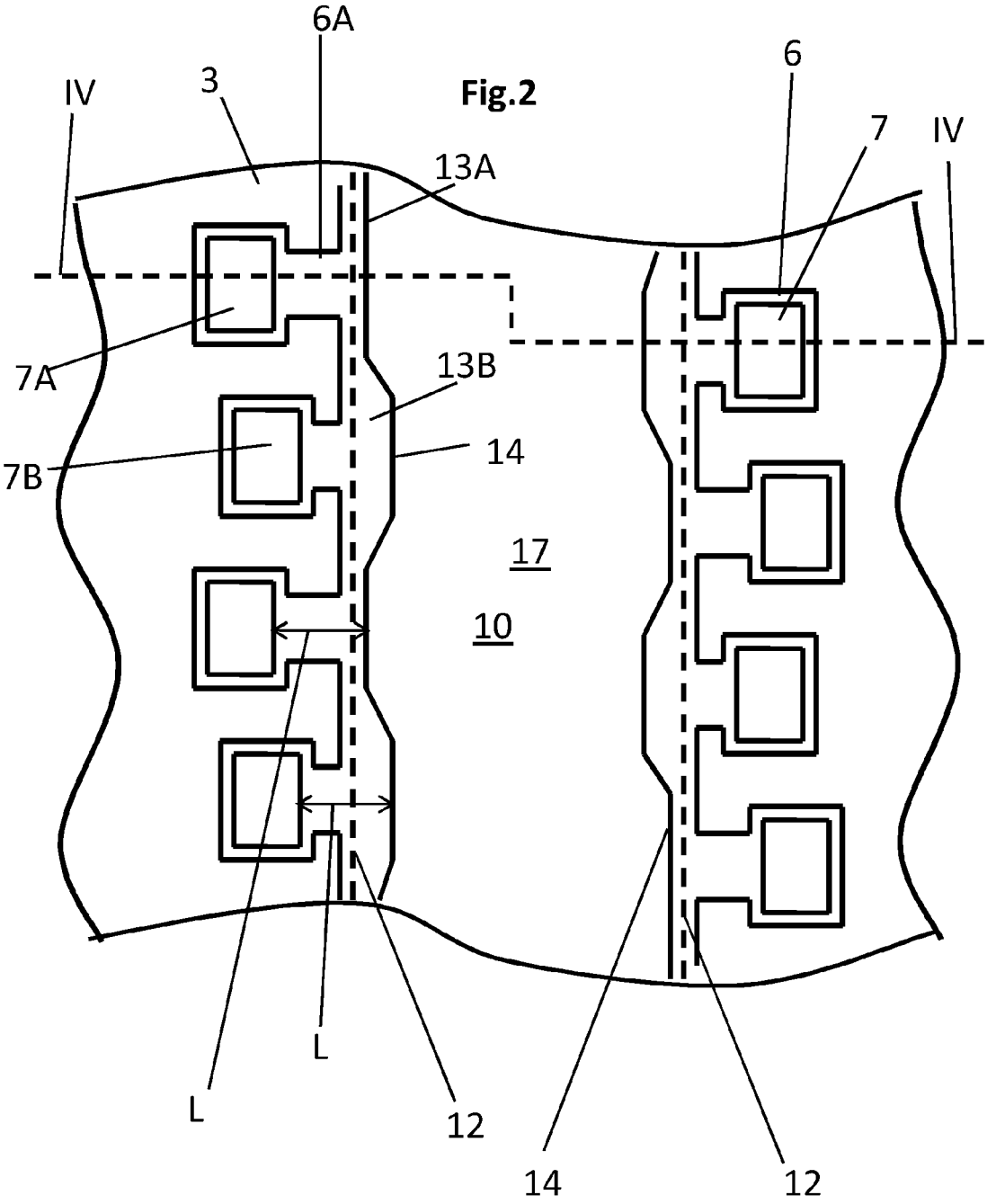
FIG. 2 shows a diagrammatic cross sectional top view of an embodiment of a print head.
Figure 4A:
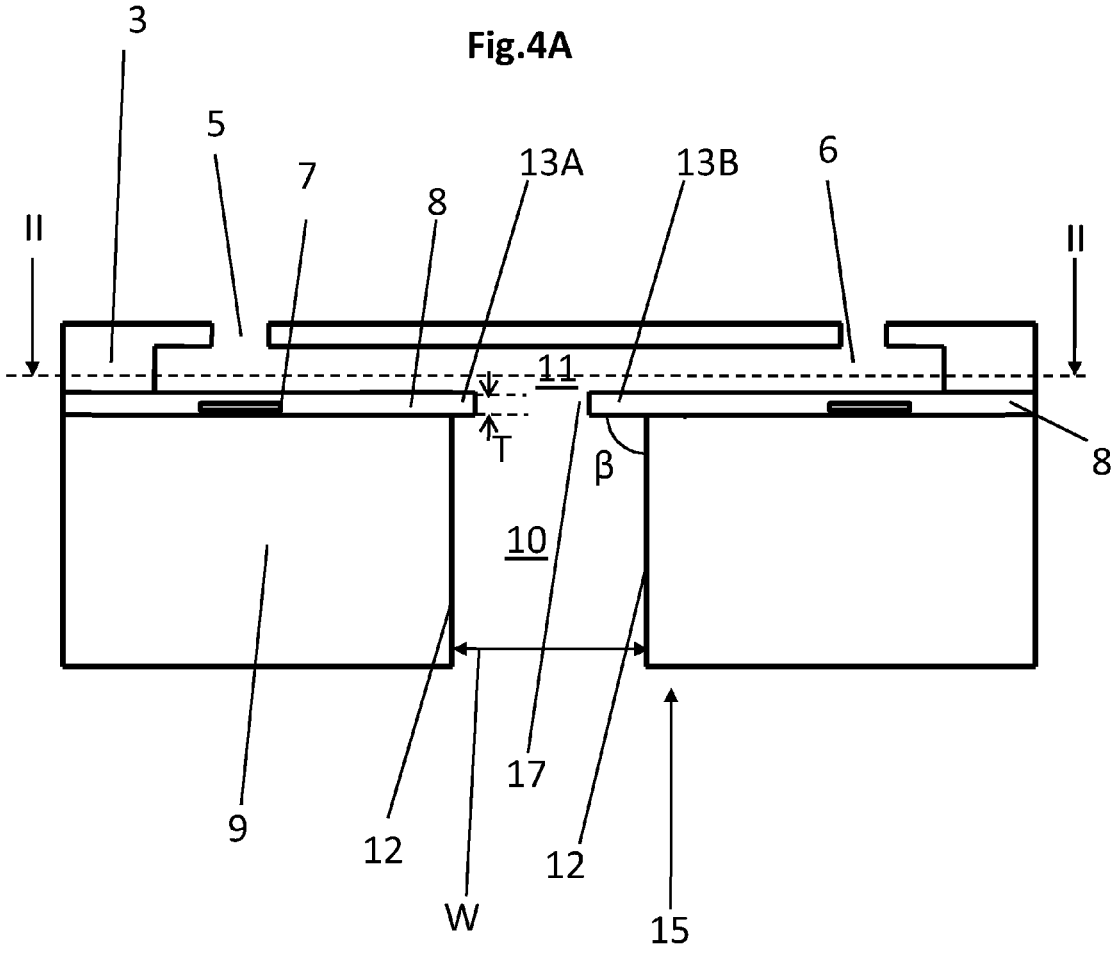
FIG. 4A shows a diagrammatic cross sectional side view of an embodiment of a print head.

FIG. 2 shows a cross-sectional top view of a portion of an embodiment of the print head 2. FIG. 4A represents a cross-sectional side view of an embodiment of the print head 2. The print head 2 of the cross-sectional side view of FIG. 4A may correspond to the print head 2 of the cross sectional top view of FIG. 2. The cross section of FIG. 2 is indicated as an interrupted line II-II in FIG. 4A. The cross section of FIG. 4A is indicated as an interrupted line IV-IV in FIG. 2.

In an embodiment, the nozzle plate 3 may include any suitable material that is capable of withstanding prolonged exposure to inkjet inks. Such material may include a photo-imageable epoxy, such as SU8 (diglycidyl ether bisphenol A (DGEBA) based negative photoresist), photo-imageable polysiloxane based chemistries such as polyset, photo-imageable polyimides, polynorbornenes and/or the like and/or any combination of the foregoing.

The nozzle plate 3 may comprise nozzles 5 for ejecting the fluid onto media. The fluid may comprise a colorant such as ink, or a coating, or any fluid for deposition onto print media to achieve a desired effect. The colorant may for example comprise any color, such as cyan, magenta, yellow and black, as well as white, grey or black, and/or any combination of these. The nozzle plate 3 may comprise fluid chambers 6 in connection with the respective nozzles 5. One or more fluid chambers 6 may be connected to one or more nozzles 5. In the shown example one fluid chamber 6 is arranged to provide fluid to one corresponding nozzle 5.

The print head 2 may comprise actuators for stimulating the ejection of the fluid through the nozzles 5. The actuators may comprise resistors 7 for heating the fluid. The resistors 7 may be provided in or near the fluid chambers 6 for stimulating the fluid in the fluid chambers 6, for ejecting the fluid out of the chambers 6, through the respective nozzles 5. The resistors 7 may be arranged to heat the fluid in the chambers 6 so as to eject the fluid through the respective nozzles 5. The resistors 7 may be provided near and/or in the bottom of the chamber 6. The bottom of the chamber 6 may be provided with, or formed by, one or more thin film layers 8 which may include circuitry for driving the resistors 7. For example, suitable material for one or more thin film layers 8 may include silicon oxide, silicon nitride and/or tantalum.

The print head 2 may comprise a substrate 9 onto which the nozzle plate 3 is applied, for example grown or deposited. A fluid feed channel 10 may extend through the substrate 9. The substrate 9 may comprise silicon.

The fluid feed channel 10 may extend from a back side 15 of the substrate 9 up to the thin film layer 8. In the shown embodiment, a thin film layer opening 17 and an intermediate channel 11 extends between the fluid feed channel 10 and the chambers 6. The fluid feed channel 10 may be connected to the chambers 6 through the thin film opening 17 and the intermediate channel 11. The intermediate channel 11 may extend above the fluid feed channel 10 and between the chambers 6. As can be seen from FIG. 2, the resistors 7 and the fluid chambers 6 may be arranged along the fluid channel 10, for example on both sides of the fluid feed channel 10. The resistors 7 and the chambers 6 may be arranged along the intermediate channel 11. Fluid may flow from the fluid feed channel 10 to the chambers 6 through thin film opening 17 and the intermediate channel 11. Furthermore chamber channels 6A may be provided to guide fluid to the respective chambers 6, for example between the intermediate channels 11 and the chambers 6.

The fluid channel 10 is formed by at least one fluid channel wall 12. In the embodiment shown in FIG. 2, the fluid channel 10 comprises two opposite fluid channel walls 12. A row of fluid chambers 6 may be arranged along each fluid channel wall 12. The fluid feed channel 10 may have a substantially elongate shape as seen in a direction perpendicular to the substrate 9 and/or nozzle plate 3. The fluid feed channel 10 may be rectangular shaped. The chambers 6 and/or resistors 7 may be arranged on both sides of the elongate shape, along the respective opposite walls 12, as depicted in FIG. 2. In the shown embodiment, the fluid feed channel walls 12 may comprise opposite relatively straight walls 12. In other embodiments, the fluid feed channel wall 12 may be round, or may have irregular shapes. For example, the fluid feed channel 10 may have an oval, round, rectangular, triangular cross section, or any other suitable cross section, as seen from a view perpendicular to the substrate surface.

The resistors 7 may be arranged in a staggered pattern with respect to the respective wall 12 of the fluid feed channel 10. At least one row of resistors 7 may be arranged on each side of the fluid feed channel 10. The chambers 6 may be arranged in a corresponding staggered pattern.

The print head 1 may comprise cantilevers 13 extending over the fluid feed channel walls 12 and partly over the fluid feed channel 10. The fluid feed channel walls 12 may border onto the cantilever 13, extending up to a cantilever 13. The cantilever 13 may have a staggered edge 14. The thin film opening 17 is provided between the cantilevers 13, its staggered border determined by the cantilever edges 14. The cantilever edges 14 also form the edges of the opening 17. The staggered edge 14 may correspond to the staggered pattern of the resistors 7. For example, where each resistor 7A is placed backwards with respect to the fluid feed channel wall 12, first cantilever portions 13A may extend by less distance over the fluid feed channel wall 12 than its neighboring second cantilever portions 13B (FIG. 2). On the other hand, where the resistor 7B is arranged closer to the respective fluid feed channel wall 12, the corresponding second cantilever portion 13B may extend relatively far over the fluid feed channel wall 12.

In an embodiment, an advantageous thickness T of the thin film layer 8 and/or the cantilever 13 may be around approximately 1 or 5 micron, for example approximately 10 micron or less, or approximately 3 micron or less.

A fluid path length L between a respective staggered edge portion 14 and a respective resistor edge may be approximately the same for each resistor 7. In other words, an approximately constant shelf length may be achieved, wherein the shelf length is synonymous for said fluid path length L. The fluid path length L may for example be defined as the shortest distance between the edge of a resistor 7 and the closest edge 14 portion of the cantilever 13.

To achieve a constant fluid path length L the staggered cantilever edge 14 may have any suitable shape, as can be seen from the different top views in FIGS. 2, 3, 5 and 6. In one embodiment, the cantilever edges 14 may comprise alternating straight portions that are parallel to the fluid feed channel wall 12, an embodiment of which is depicted in FIG. 2. In other embodiment, the cantilever 13 may comprise cantilevers 13 having rounded edges, sharp corners, straight corners, rounded corners, irregular shapes, etc. Some examples will be discussed in this disclosure.

Figure 3:
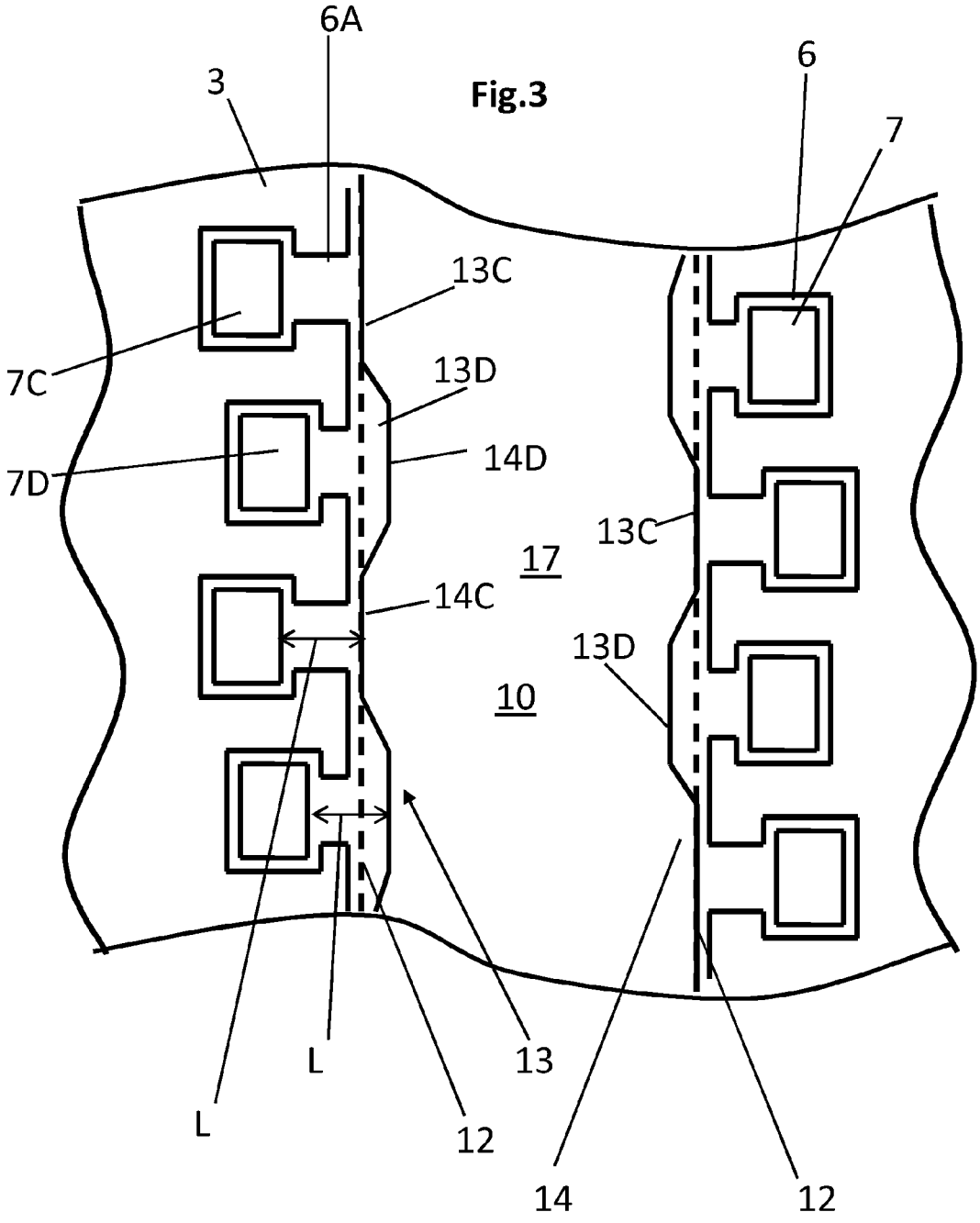
FIG. 3 shows a diagrammatic cross sectional top view of a further embodiment of a print head.

In an embodiment, the cantilever 13 comprises an interrupted cantilever 13. As illustrated in FIG. 3, the cantilever 13 may have only second cantilever portions 13D because the first portions 13C do not project with respect to the walls 12 and therefore do not have the properties of a cantilever. The cantilever 13, as shown in FIG. 3, may have a staggered edge 14 wherein the first portions 13C may form indents 14C of the cantilever edge 14. The second cantilever portions 13D project with respect to the walls 12. A fluid path length L between an edge of a respective resistor 7C and the wall 12 and/or the cantilever indent 14C may be approximately the same as the fluid path length L between the edge of a neighboring resistor 7D and the edge 14D of the corresponding cantilever 13D.

The staggered shape of the cantilever edge 14 with respect to the fluid channel wall 13 may also show in the side view, as shown in FIG. 4A. A first cantilever edge portion 14A of the first cantilever portion 13A may extend over the fluid feed channel wall 12 with a first distance. A second staggered edge portion 14B of the second cantilever portion 13B, opposite the first cantilever edge portion 13A, may extend over the fluid feed channel wall 12 with a second distance. The first distance may be smaller than the second distance.

The fluid feed channel 10 may extend through the substrate 9, as shown in FIG. 4A. The cantilever 13 may form part of the thin film layer 8. The thin film layer 8 may be arranged on top of the substrate 9 and extend over the fluid feed channel 10, forming the cantilever 13.

The fluid path length L may be approximately 20 micron or less. The fluid path length L may be approximately 10 micron or less, or approximately 6 micron or less. In one embodiment, the fluid path length L is approximately 4 micron or less. The fluid path length L may be determined by forming the opening 17 in the thin film layer 8 and applying the resistors 7. The resistors 7 may be provided onto the thin film layer 8. The processing of the thin film layer 8 and the nozzle plate 3 may comprise a photolithography process, for example photo-imaging and subsequently etching and/or ashing, for formation of the chambers 6 and chamber channels 6A. The fluid path length L may be determined with relative precision and relatively small margin, for example separately from the formation of the fluid feed channel 10.

The fluid feed channel 10 may be formed by processing the substrate 9, for example by etching and/or laser trenching, as will be explained below. The fluid feed channel 10 may have relatively straight walls 12, at least as seen from a cross sectional side view, as in FIG. 4A. The angle β between the respective walls 12 and the cantilever 13 may be approximately straight. The fluid feed channel 10 may be formed by removing substrate material in a direction from the backside 15 to the front surface 4. This may be achieved by dry etching the fluid feed channel 10.

Figure 4B:
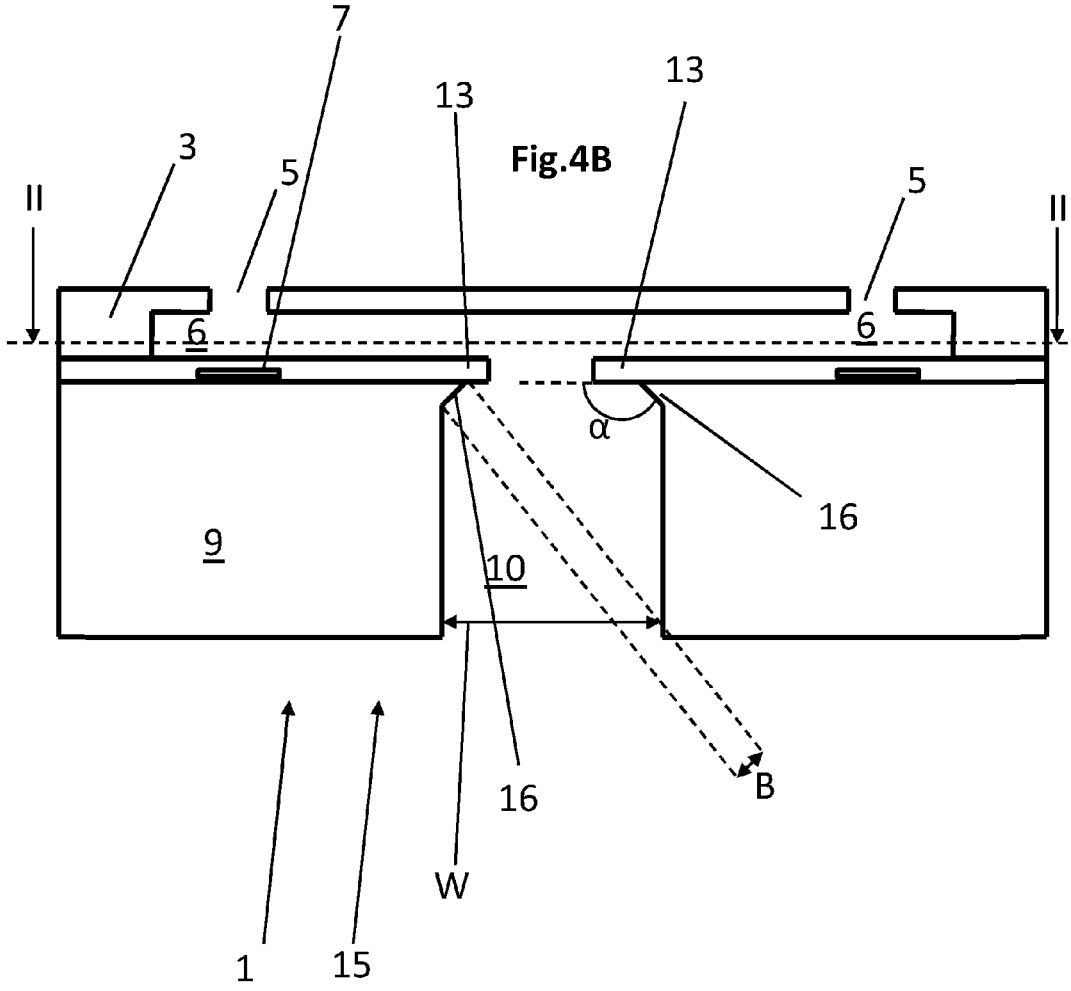
FIG. 4B shows a diagrammatic cross sectional side view of another embodiment of a print head.

A further embodiment of a print head 1 is shown in FIG. 4B, which may also correspond to cross section IV-IV of FIG. 2. The portions 16 of the wall 12 bordering onto the cantilever 13 may bend towards the inside of the fluid feed channel 10. The bended portions 16 may have a length B of approximately 50 micron or less, for example between 0 and approximately 50 micron. The bended portion 16 may be relatively flat or rounded. The bended portion 16 may border onto the staggered cantilever 13, the cantilever 13 extending over the bended portion 16. The bended portion 16 may comprise an inclined portion, for example consisting of an approximately straight inclined wall portion having an inclination a between the bended portion 16 and the cantilever 13 of between approximately 100 and approximately 150°, for example approximately 125°. The bended portion 16 may for example be formed by forming the final portion of the fluid feed channel 10 by wet etching the substrate 9, for example for a relatively short period, for example of approximately 180 minutes or less, approximately 120 minutes or less, approximately 60 minutes or less, or approximately 45 minutes or less, or approximately 30 minutes or less.

Figure 5:
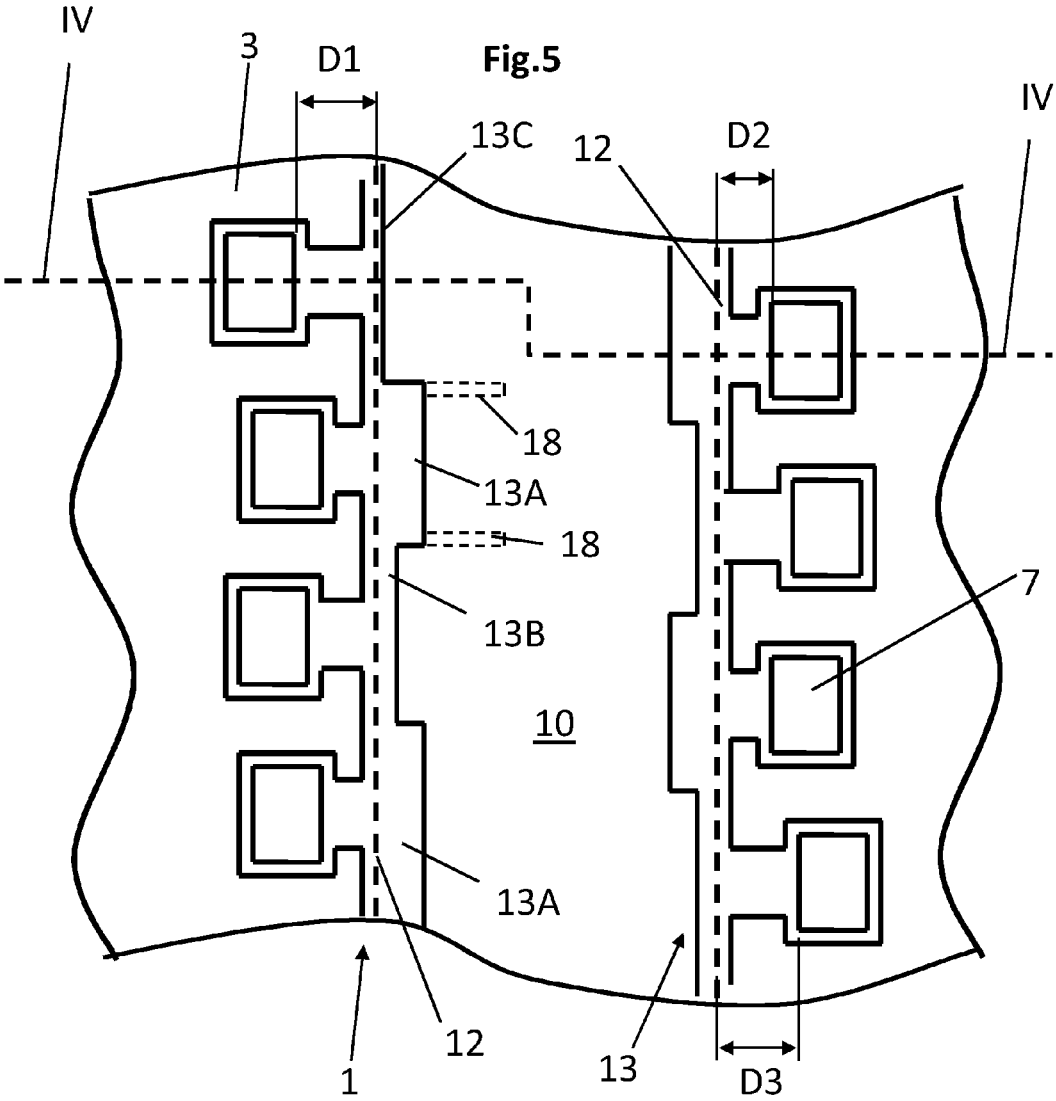
FIG. 5 shows a diagrammatic cross sectional top view of another embodiment of a print head.

In FIG. 5 an embodiment is shown wherein the resistors 7 are arranged according to a staggered pattern with respect to the fluid feed channel wall 12. The resistors have more than two different distances D1, D2, D3, with respect to the fluid feed channel wall 12, for example three, four or more different distances D1, D2, D3. At least two different cantilevers portions 13A, 13B, 13C extend over different distances over the fluid feed channel wall 12. The staggered pattern may have a regular or a random pattern. The cantilever portions 13A, 13B, 13C may have approximately straight corners, for example merlon like shapes.

In an embodiment, the staggered pattern may be arranged according to a drive circuit connected to the resistors 7, wherein the respective different distances D1, D2, D3 between the resistor 7 edges and the fluid wall 12 may be the same for resistors 7 that are connected to the same drive wire of said drive circuit.

The fluid feed channel wall 12 and/or the cantilever 13 may be provided with projections 18 between two different cantilever portions 13A, 13B. The projections 18 may extend away from the chambers 6, into the fluid feed channel 10 and/or into the thin film opening 17. The projections may be arranged to prevent cross talk of fluid between adjacent chambers 6. The projections 18 may comprise ribs, poles, walls, or the like A cross sectional side view of the embodiment of FIGS. 5 and 6 may be represented by FIG. 4A or 4B, as indicated by interrupted line IV-IV.

Figure 6:
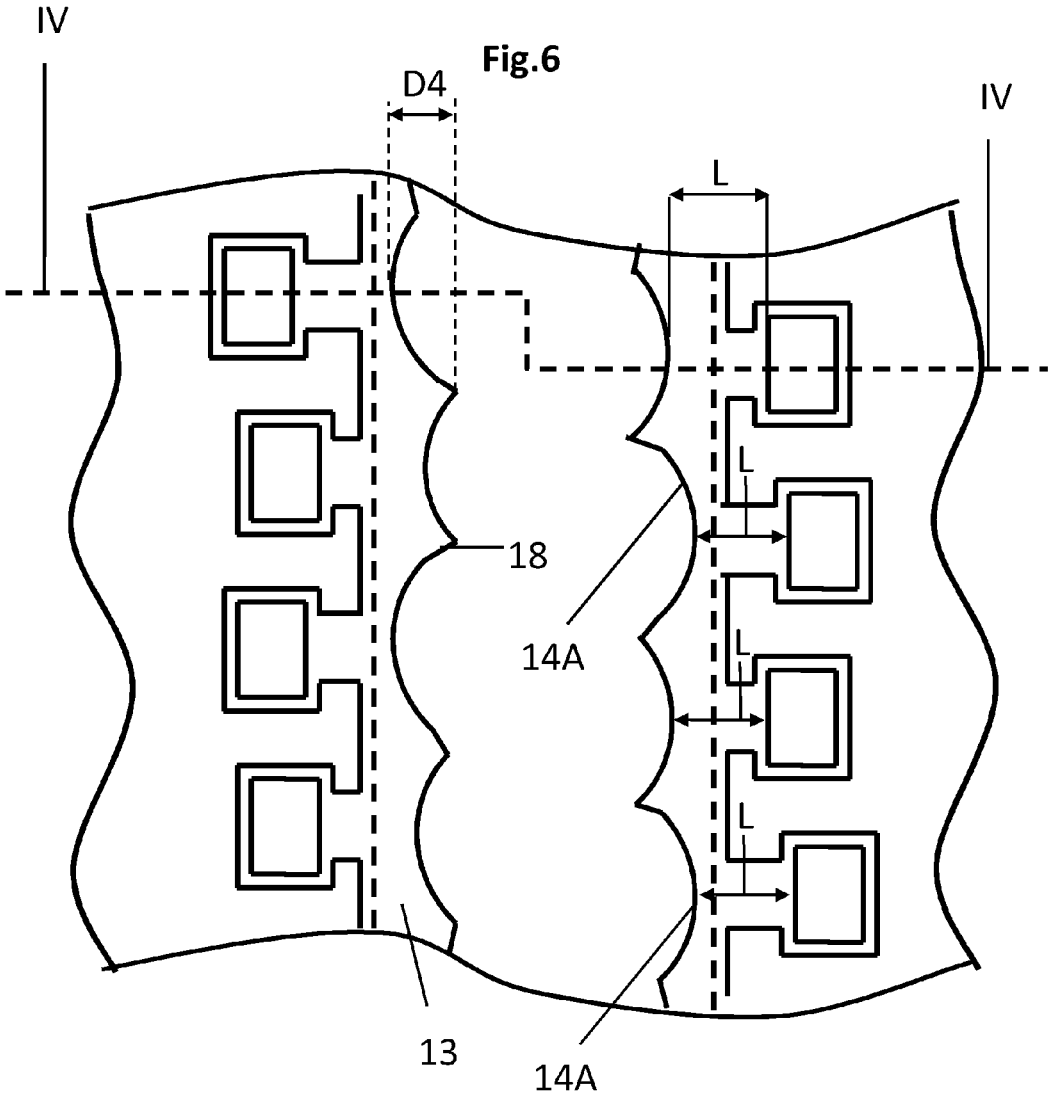
FIG. 6 shows a diagrammatic cross sectional top view of another embodiment of a print head.

In FIG. 6 a portion of a further embodiment of a print head 1 is shown. FIG. 6 shows a cross sectional top view corresponding to the cross sectional side view of FIG. 4A, as indicated by interrupted line IV-IV. The cantilever 13 may have rounded edge portions 14A extending inwards into the cantilever 13, between relatively sharp portions. The sharp portions may function as projections 18 for guiding fluid and preventing cross talk between fluid paths as explained above. The depth D4 of each of the rounded edge portions 14A may be adapted to match a predetermined and constant fluid path length L. The rounded edge portions 14A may be arranged opposite to each corresponding resistor 7 so that the respective fluid path length L is approximately equal.

In a further embodiment (not shown), the corners of the cantilever portions 13A, 13B and the corners between the cantilever portions 13A, 13B may be rounded. For example, sharp corners of cantilever portions 13A, 13B may be prevented.

As shown by the examples of FIGS. 2, 3, 5 and 6, different embodiments of print heads 1 may be suitable. For example, the arrangement of the print head 1 may depend on the chosen method of manufacture.

Figure 7:
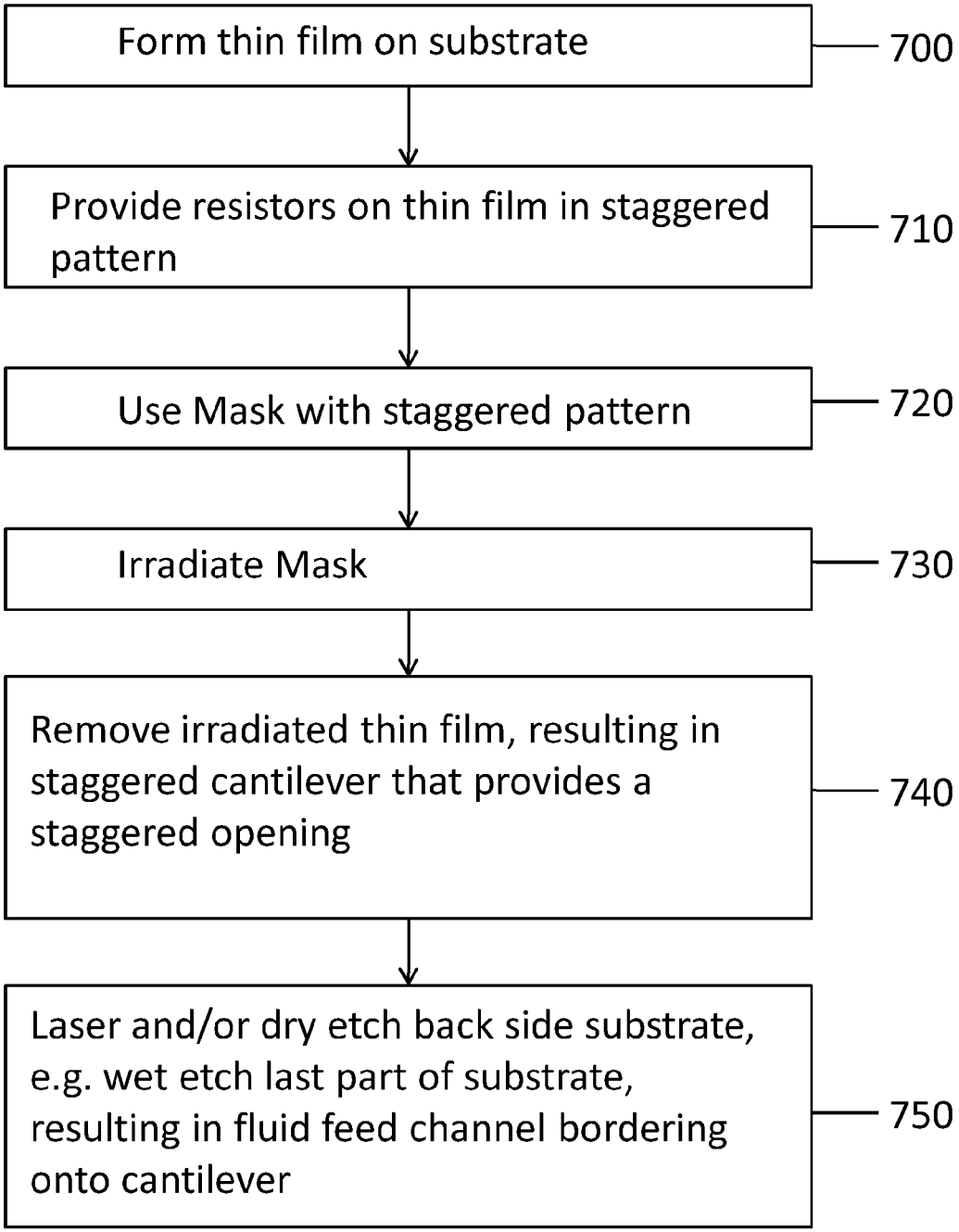
FIG. 7 shows a flow chart of an embodiment of a method of manufacturing a thermal inkjet print head.

An embodiment of a method of manufacturing a print head 1 may be explained with reference to the flow chart of FIG. 7. In the method, a substrate 9 may be provided. A thin film layer 8 may be formed onto the substrate 9, for example by growing or a suitable deposition process, as indicated by block 700. Suitable deposition processes may include CVD (Chemical Vapor Deposition), PVD (Physical Vapor Deposition), ALD (Atomic Layer Deposition) and/or other suitable deposition techniques. The thin film layer 8 may comprise one or multiple layers. The thin film may comprise a thin film drive circuit for driving the resistors 7.

In a next block 710, the resistors 7 may be applied to the thin film layer 8. The resistors 7 may be adjoined to the thin film drive circuit. The resistors 7 may be adhered to the thin film layer 8. The resistors 7 may be arranged in a staggered pattern with respect to each other. The resistors 7 may be staggered to be connected to respective drive circuit portions. Each row of resistors 7 may be arranged so that it will extend along one side of a thin film opening 17 and/or fluid feed channel 10 that may be formed in a subsequent step. Within each row, the resistors 7 may be arranged in a staggered pattern.

Subsequently the thin film opening 17 may be formed in the thin film layer 8 by removing thin film layer 8. Formation of the thin film opening 17 may determine the staggered shape of the cantilever 13. A mask having a staggered pattern may be applied for formation of the staggered cantilever 13, as indicated by block 720. The mask may comprise a staggered pattern, wherein the staggered pattern may correspond to the drive circuit pattern and/or the staggered pattern of the arrangement of the resistors 7. In one embodiment, the thin film layer 8 may be photo-imaged. The mask may be irradiated, as shown in block 730, so that the thin film layer 8 is selectively irradiated. In an embodiment, the irradiated portion of the thin film layer 8 may be removed by etching, resulting in an opening 17 having staggered edges that correspond to the staggered arrangement of the resistors 7, as indicated by block 740. The mask may be arranged so that the fluid path lengths L are approximately the same for each resistor 7

As shown in block 750, the fluid feed channel 10 may be shaped in the substrate 9. The fluid feed channel 10 may be formed by removing substrate material, starting at the backside 15 of the substrate 9. For example, the fluid feed channel 10 may be formed by a first relatively rough removal process and thereafter by a finer removal process with more precise depth control. For example, the fluid feed channel 10 may be formed by laser trenching and/or dry etching. A first portion of the substrate 9 may be removed by laser trenching. A second or final portion that opens into the thin film opening 17 may be formed by dry and/or wet etching. For example, the backside width W of the fluid feed channel 10 (see FIG. 6) may be approximately 500 micron or less, approximately 300 micron or less, or approximately 200 micron or less. In this description, the width W may be defined as the maximum fluid feed channel 10 width W located near the backside 15 of the substrate 9, for example for air management.

In another embodiment, the entire fluid feed channel 10 may be formed by etching, for example by dry etching, until it is in open connection with the thin film opening 17. In a further embodiment, the fluid feed channel may be dry etched first. Then, the final portion of the substrate 9 may be removed by wet etching, for example an anisotropic wet etch process such as TMAH (tetramethylammonium hydroxide) wet etching, until it is in open connection with the opening 17. The substrate material may be removed until the fluid feed channel walls 12 border onto the thin film layer 8. The thin film opening 17 may be narrower than the fluid feed channel 10.

In an embodiment, a fluid feed channel 10 is formed having a backside fluid feed channel width W of approximately 500 micron. The fluid feed channel 10 may be formed by a laser process or a combination of laser and wet silicon etching. The final portion of the fluid feed channel 10 may be formed by an approximately 90 to approximately 180 minute TMAH silicon wet etch, so that the fluid feed channel 10 opens into the thin film opening 17.

In another embodiment, a fluid feed channel 10 having a backside width W of approximately 300 micron may be formed by laser cutting or a combination of laser and wet silicon etch. The laser and wet etch process may be adjusted to match the width W of the fluid feed channel 10. The final portion of the fluid feed channel 10 may be etched by an approximately 60 to approximately 90 minute TMAH silicon wet etch.

A further embodiment may comprise cutting out a fluid feed channel 10 approximately 200 micron or less wide by laser cutting or a combination of laser, dry etch and TMAH wet silicon etch with a TMAH wet etch time between approximately 10 and approximately 30 minutes. For example, the fluid path length L may be maintained at approximately 4 micron or less.

In an embodiment, the fluid feed channel 10 may be provided with the projections 18 in the walls 12, for example by adapting the photo mask used to etch thin film openings 17.

A final portion of the fluid feed channel 10 may be formed by a relatively short wet etch process. Keeping the wet etch process relatively short, or to a minimum, may have the advantage of limiting possible damage to the thin film layer and/or keeping the fluid feed channel 10 relatively straight. Also, this may keep total processing times of the print head short so that the respective manufacturing equipment may be available for other processes. In an embodiment, the wet etch process may be approximately 60 minutes or less, or approximately 45 minutes or less, or approximately 30 minutes or less.

In a further embodiment of the manufacture method, the nozzle plate 3 may be provided above the thin film layer 8. The nozzle plate 3 may be applied to the thin film layer 8 in one or multiple layers 8. The respective cavities 5, 6, 6A, 11, may be formed in the nozzle plate 3 by suitable manufacturing techniques including photolithography, etching and/or ashing.

The print head structure of this disclosure has the advantage of being manufactured relatively efficiently in cost and time, while providing a relatively constant fluid path length L, also known as shelf length. Moreover, the fluid path length L may be kept relatively short and constant delivering better controllability of the shooting of the fluid through the respective nozzles 5. Both formation of the fluid feed path (i.e. the slotting process) as the formation of the cantilever 13 and thin film opening 17 may be relatively cost and time efficient because of the reduced complexity of this approach.

In a first aspect of this disclosure, a thermal inkjet print head 1 may comprise (i) a fluid feed channel 10 for delivering fluid, (ii) fluid chambers 6 arranged near the fluid feed channel 10 for receiving fluid from the fluid feed channel 10, and (iii) resistors 7 for actuating the fluid in the chambers 6. The resistors 7 may be arranged in a staggered pattern with respect to a fluid feed channel wall 12. A cantilever 13 may extend over the fluid feed channel wall 12, having a staggered edge 14 that may follow the staggered pattern of the resistors 7 so that the fluid path length L between a resistor 7 and a corresponding staggered edge portion 14A, 14B is approximately the same for each resistor 7.

In a second aspect of this disclosure, a method of manufacturing a thermal inkjet print head 1 may comprise (i) forming a thin film layer 8 onto a substrate 9, (ii) providing resistors 7 onto the thin film layer 2 according to a staggered pattern, (iii) using a mask for processing the thin film layer 8, the mask comprising a staggered pattern for forming a staggered opening 17 in the thin film layer 8, so that fluid path lengths L between the resistors 7 and the corresponding closest opening edges 14 are approximately the same for each resistor 7. The method may further comprise (iv) removing thin film layer 8 to form the staggered opening 17, and (v) forming a fluid feed channel 10 through the substrate 9, so that a fluid feed channel wall 10 abuts onto the thin film layer 8, and the fluid feed channel 10 is in open connection with the opening 17, while the thin film layer 8 partly extends over the fluid feed channel wall 10 as a cantilever 13.

In a third aspect of this disclosure, a thermal inkjet print head 1 may be provided. The print head 1 may comprise (i) fluid chambers 6 for storing fluid, (ii) resistors 7 arranged to eject fluid out of the chambers 6, (iii) a fluid feed channel 10, defined by a fluid feed channel wall 12, for transporting fluid to the chambers, and (iv) a cantilever 13 at least partly extending over the fluid feed channel 10, wherein (i) the resistors 7 are arranged according to a staggered pattern with respect to the fluid feed channel wall 12, and (ii) the edge 14 of the cantilever 13 forms the fluid feed channel opening 17 for connecting the fluid feed channel 10 to the chambers 6, the edge 14 having a staggered pattern corresponding to the staggered pattern of the resistors 7 so that the fluid path length L between the resistors 7 and corresponding closest edge portions 14A, 14B is approximately the same for each resistor 7 and corresponding closest edge portion 14A, 14B.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality, while a reference to a certain number of elements does not exclude the possibility of having more elements. A single unit may fulfill the functions of several items recited in the disclosure, and vice versa several items may fulfill the function of one unit.

The mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. Thermal inkjet print head, comprising a fluid feed channel for delivering fluid, fluid chambers arranged near the fluid feed channel for receiving fluid from the fluid feed channel, resistors for actuating the fluid in the chambers, arranged in a staggered pattern with respect to a fluid feed channel wall, and a cantilever extending over the fluid feed channel wall, having a staggered edge that follows the staggered pattern of the resistors so that the fluid path length between a resistor edge and a corresponding staggered edge portion is approximately the same for each resistor;

the cantilever comprising a first staggered edge of a first cantilever portion on the opposite side of the fluid feed channel from a second staggered edge of a second cantilever portion, wherein a first distance between the first staggered edge and the fluid feed channel wall over which the first staggered edge extends is different from a second distance between the second staggered edge and the fluid feed channel wall over which the second staggered edge extends.

2. Thermal inkjet print head according to claim 1, comprising a substrate and a thin film layer on top of the substrate, wherein the fluid feed channel extends through the substrate, and the thin film layer forms the cantilever.

3. Thermal inkjet print head according to claim 1, wherein the fluid feed channel wall borders on the cantilever.

4. Thermal inkjet print head according to claim 1, the fluid path length between an edge of each resistor and the corresponding staggered edge is approximately 20 micron or less.

5. Thermal inkjet print head according to claim 1, the fluid path length between an edge of each resistor and the corresponding staggered edge is approximately 10 micron or less.

6. Thermal inkjet print head according to claim 1, wherein the fluid feed channel wall comprises a straight portion, and a bended portion close to the cantilever having a length of between approximately 0 and approximately 50 micron.

7. Thermal inkjet print head according to claim 6, wherein the fluid feed channel wall comprises a straight portion, and an inclined portion having an angle between approximately 100 and 150 degrees relative to the cantilever.

8. Thermal inkjet print head according to claim 1, wherein the fluid feed channel comprises two parallel fluid feed channel walls opposite to each other, the fluid channel having a rectangular shape.

9. Thermal inkjet print head according to claim 1, comprising nozzles corresponding to the fluid chambers, wherein the thin film layer forms the bottom of the fluid chamber, and the resistor is provided in the fluid chamber bottom for ejecting the fluid out of the chamber and through the nozzle.

10. Thermal inkjet print head according to claim 1, comprising projections extending away from the chambers, between two adjacent cantilever portions, for preventing cross talk of fluid flowing to adjacent chambers corresponding to the adjacent cantilever portions.

11. Method of manufacturing a thermal inkjet print head, comprising forming a thin film layer onto a substrate, providing resistors onto the thin film layer according to a staggered pattern, using a mask for processing the thin film layer, the mask comprising a staggered pattern for forming a staggered opening in the thin film layer, so that fluid path lengths between the resistors and the corresponding closest opening edges are approximately the same for each resistor, removing thin film layer to form the staggered opening, and forming a fluid feed channel through the substrate, so that a fluid feed channel wall abuts onto the thin film layer, and the fluid feed channel is in open connection with the opening, while the thin film layer partly extends over the fluid feed channel wall as a cantilever comprising a first cantilever portion on the opposite side of the fluid feed channel from a second cantilever portion, wherein a first distance that the first cantilever portion extends over the fluid feed channel wall is different from a second distance that the second cantilever portion extends over the fluid feed channel wall.

12. Method according to claim 11, comprising dry etching the fluid feed channel.

13. Method according to claim 12, comprising dry etching the fluid feed channel until it is in open connection with the opening in the thin film layer.

14. Method according to claim 12, comprising, after dry etching, wet etching the fluid feed channel until it is in open connection with the opening in the thin film layer for a period of 60 minutes or less.

15. Method according to claim 11, comprising providing a nozzle plate on top of the thin film layer.

16. Thermal inkjet print head, comprising fluid chambers for storing fluid, resistors arranged to eject fluid out of the chambers, a fluid feed channel, defined by a fluid feed channel wall, for transporting fluid to the chambers, and a cantilever at least partly extending over the fluid feed channel, wherein the resistors are arranged according to a staggered pattern with respect to the fluid feed channel wall, and the edge of the cantilever forms an opening for connecting the fluid feed channel to the chambers, the edge having a staggered pattern corresponding to the staggered pattern of the resistors so that the fluid path length between the resistors and the corresponding closest edge portions is approximately the same for each resistor and corresponding closest edge portion;

comprising a first cantilever portion on the opposite side of the fluid feed channel from a second cantilever portion, wherein a first distance that the first cantilever portion extends over the fluid feed channel wall is different from a second distance that the second cantilever portion extends over the fluid feed channel wall.

* * * * *

UNITED STATES PATENT AND TRADEMARK OFFICE

CERTIFICATE OF CORRECTION

PATENT NO. : 8,714,710 B2
APPLICATION NO. : 13/640241
DATED : May 6, 2014
INVENTOR(S) : Rio Rivas et al.

It is certified that error appears in the above-identified patent and that said Letters Patent is hereby corrected as shown below:

In the Claims

In column 9, line 8, in Claim 8, after "fluid" insert -- feed --.

Signed and Sealed this
Twenty-fifth Day of August, 2015

Michelle K. Lee

Michelle K. Lee
*Director of the United States Patent and Trademark Office*